United States Patent [19]

Sedgwick et al.

[11] Patent Number: 4,982,907

[45] Date of Patent: Jan. 8, 1991

[54] DOCUMENT SHREDDER

[76] Inventors: Brian C. Sedgwick, 4537 Katherine Ave., Sherman Oaks, Calif. 91423; Raymond K. Mackenzie, 1031 Adelaine Ave., Sherman Oaks, Calif. 91030

[21] Appl. No.: 187,286

[22] Filed: Apr. 28, 1988

[51] Int. Cl.[5] ..... B02C 18/18

[52] U.S. Cl. ..... 241/236; 241/101.2; 241/230; 241/286; 83/664

[58] Field of Search ..... 241/236, 36, 101.2, 241/243, 294, 295, 230, 231, 234, 286, 290; 83/425.4, 508.3, 664, 698

[56] References Cited

U.S. PATENT DOCUMENTS

| | | | |
|---|---|---|---|
| 477,848 | 12/1923 | Pardee | 241/295 |
| 957,038 | 5/1910 | Dalgety | 241/295 X |
| 2,150,192 | 5/1935 | Sander | 146/122 |
| 2,182,219 | 12/1939 | Ashley | 83/664 X |
| 2,613,571 | 10/1952 | Herman | 83/664 X |
| 2,770,302 | 11/1956 | Lee | 241/236 X |
| 3,880,361 | 4/1975 | Schwarz | 241/36 |
| 4,034,918 | 7/1977 | Culbertson et al. | 241/36 |
| 4,052,013 | 10/1977 | Ehrlich et al. | 242/101.2 |
| 4,411,391 | 10/1983 | Crane | 242/232 |
| 4,545,537 | 10/1985 | Kimura et al. | 241/36 |
| 4,609,155 | 9/1986 | Garnier | 241/30 |
| 4,619,407 | 10/1986 | Goldhammer | 241/30 |
| 4,665,771 | 5/1987 | Mitchell | 74/788 |

FOREIGN PATENT DOCUMENTS

| | | | |
|---|---|---|---|
| 53481 | 1/1978 | Japan | 83/664 |
| 2171028 | 8/1986 | United Kingdom | 241/236 |

*Primary Examiner*—Joseph M. Gorski
*Attorney, Agent, or Firm*—John J. Posta, Jr.

[57] ABSTRACT

A document shredder comprises a pair of cutter assemblies, each having a shaft on which there are cutter disks with interspersed spacers. The disks overlap to form a nip. On the one shaft, additionally, there are rings mounted in the spacers, and that permits the shaft to be axially compressed tighter than the shaft without rings. This provides for relative flexibility and axial movement between the shafts such that foreign objects can more easily be removed. A 20 inch cutter assembly driven by a single phase motor through a planetary gear system is provided.

28 Claims, 3 Drawing Sheets

DOCUMENT SHREDDER

BACKGROUND

This invention relates to a document shredder. In particular it concerns a shredder for relatively heavy duty document shredding.

Many document shredders are known which have different characteristics. Essentially a document shredder includes two cutter assemblies which rotate relative to each other, there being overlapping blades or cutting discs on the assemblies which rotate to draw into a nip between the discs the documents to be shredded. In practice a difficulty which arises includes the jamming of the shredder when the documents loaded for shredding are either too numerous or too wide. Occasionally, jamming is caused by foreign objects which enter the nip between the discs. In such situations, it is usually necessary to stop the rotation of the cutter assemblies and, in some cases, reverse the assemblies to remove the foreign objects. Even then difficulties can endure because the foreign object is sometimes jammed between the cutter discs in a manner in which it cannot be easily removed. This can require, at least, partial disassembly One manner of avoiding jamming of the cutter assembly or of removing foreign objects causing jamming is to provide for the cutting assemblies to be removably spring mounted towards each other. Thus, when a foreign object is jammed in the cutter assembly, the cutter assemblies can be moved apart manually or adjusted under the action of the foreign object attempting to pass between the cutter assemblies. Thereby jamming is avoided. In most cases, this is unsatisfactory since it could cause the foreign object to pass through together with documents in an unshredded form. Also, the possibility arises that operators will be tempted to put their hands close to the cutter assemblies, and this is potentially dangerous.

A different problem which arises with shredders is to provide for efficient operation for heavy duty shredders, namely shredders able to digest documents of about 20 inches width. The shredding requirement is to simultaneously shred documents into fine strips of about 1/38" width by ⅜" in length. A demand exists for heavy duty shredders having a wide mouth and cutter assembly to receive documents in the order of 20 inches, and yet be easily operable with an efficient drive.

One form of drive motor which is efficient and which operates under low power conditions would be a single phase electric motor. The problem, however, is that with a cutter assembly of about 18 inches or more, the power requirement for a shredder would normally require a three-phase motor which is relatively less energy efficient, and requires special wiring There is accordingly a need to provide for an efficient low power drive motor means, whereby power from a single phase motor can be transmitted to operate the cutter assemblY efficiently when the assembly is wide mouthed.

There is accordingly a need to provide a document shredder for high volume heavy duty operation under low power efficient conditions while avoiding the problems of jamming.

SUMMARY

By this invention there is provided a document shredder which meets the needs of a low powered highly efficient shredder with cutter assemblies constructed to avoid jamming.

According to the invention a shredder comprises a pair of cutter assemblies, each including a shaft mounted on a frame. The cutter assemblies are mounted on the shaft at spaced intervals and the shafts are parallel mounted to define a space between them for a distance so that the discs on one of the shafts extend into spaces between the discs of the other shaft in an overlapping relationship to form a nip. The cutter assemblies are formed so that there is greater axial movement between the discs on one shaft relative to the axial movement between the discs on the other shaft.

Between each of the discs there is mounted a spacer. A compressive force is applied to the discs and spacers around the shaft, thereby, to have discs and spacers abut each other along the axial length of the shaft. The compressive force applies a requisite degree of rigidity to each cutter assembly. On one of the shafts, there are additionally ring elements mounted within a bore of the spacers and in adjacency with the cutter disc. Each ring element is of a thickness greater than the thickness of each spacer. This permits the one shaft to have relatively less axial movement between the discs and the spacers.

The drive for the cutter assemblies is a single phase motor which transmits power through a planetary gear system having an efficiency greater than about 90 percent. With a cutter assembly having an axial length of about 20 inches, and the motor single phased, the shredder needs only about 1.5 horsepower to operate effectively. It is thus unnecessary to provide a three-phase power supply to the shredder.

DRAWINGS

DESCRIPTION

Figure 1:
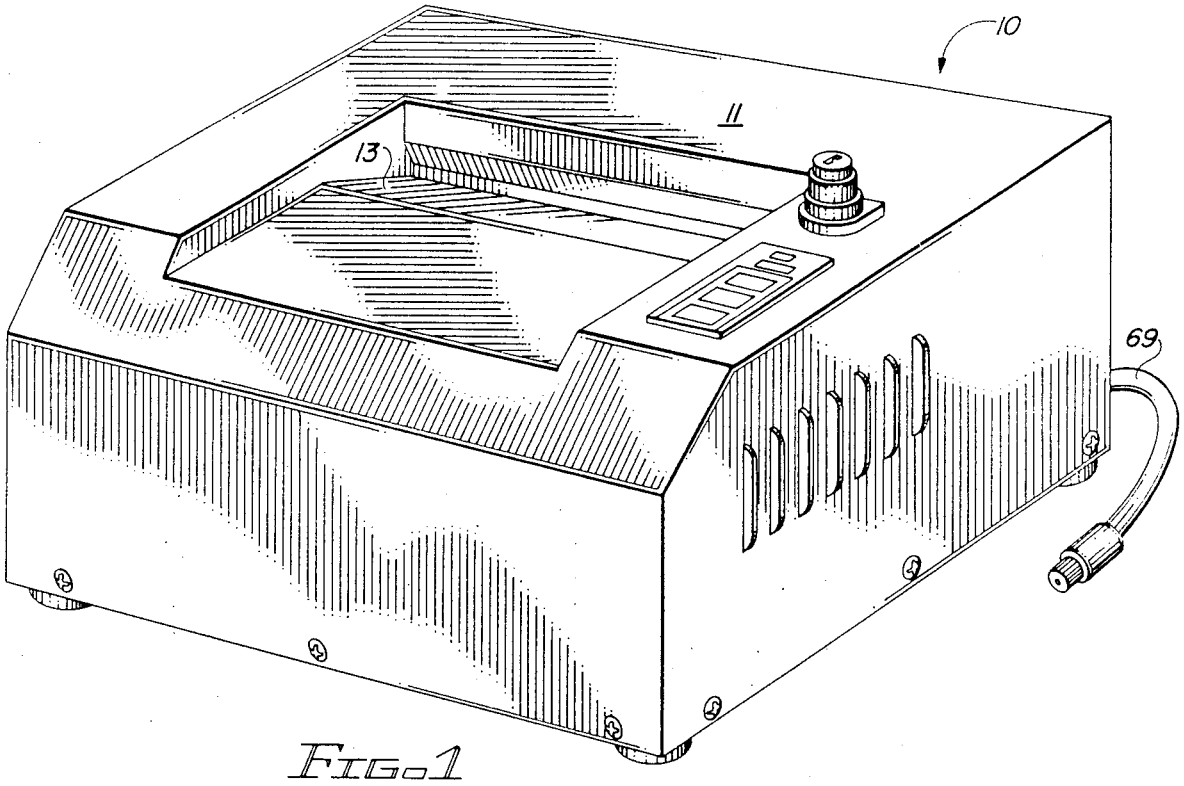
FIG. 1 is a perspective view of the document shredder with the casing in position over the frame.
Figure 2:
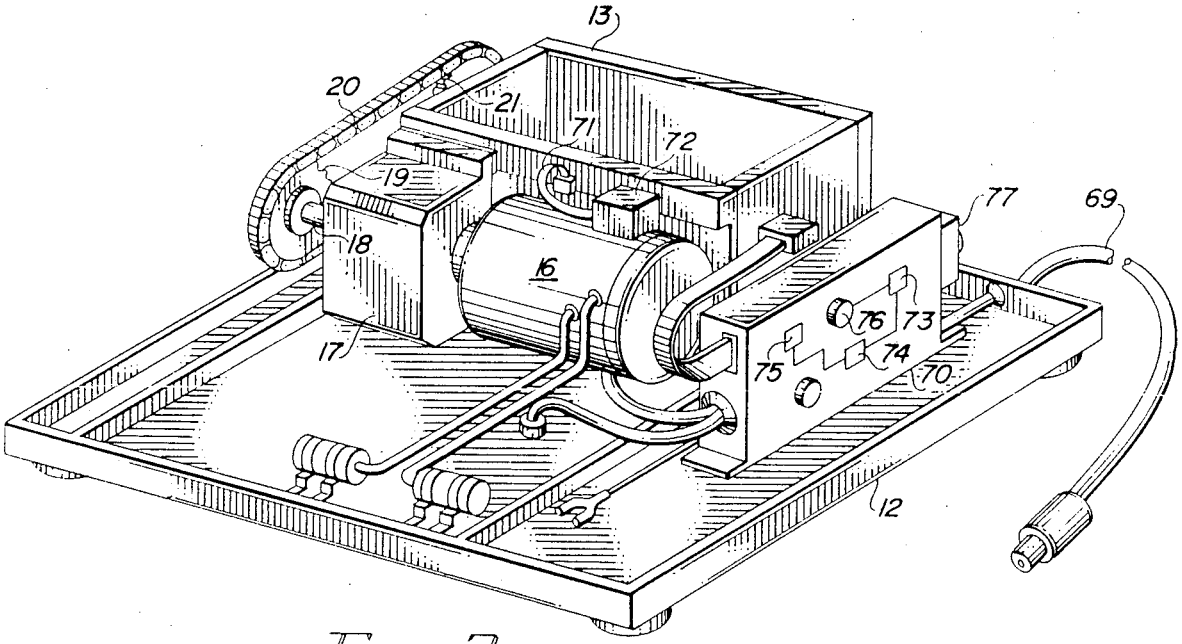
FIG. 2 is a perspective view of the inside of the document shredder machine with the outside casing removed.
Figure 3:
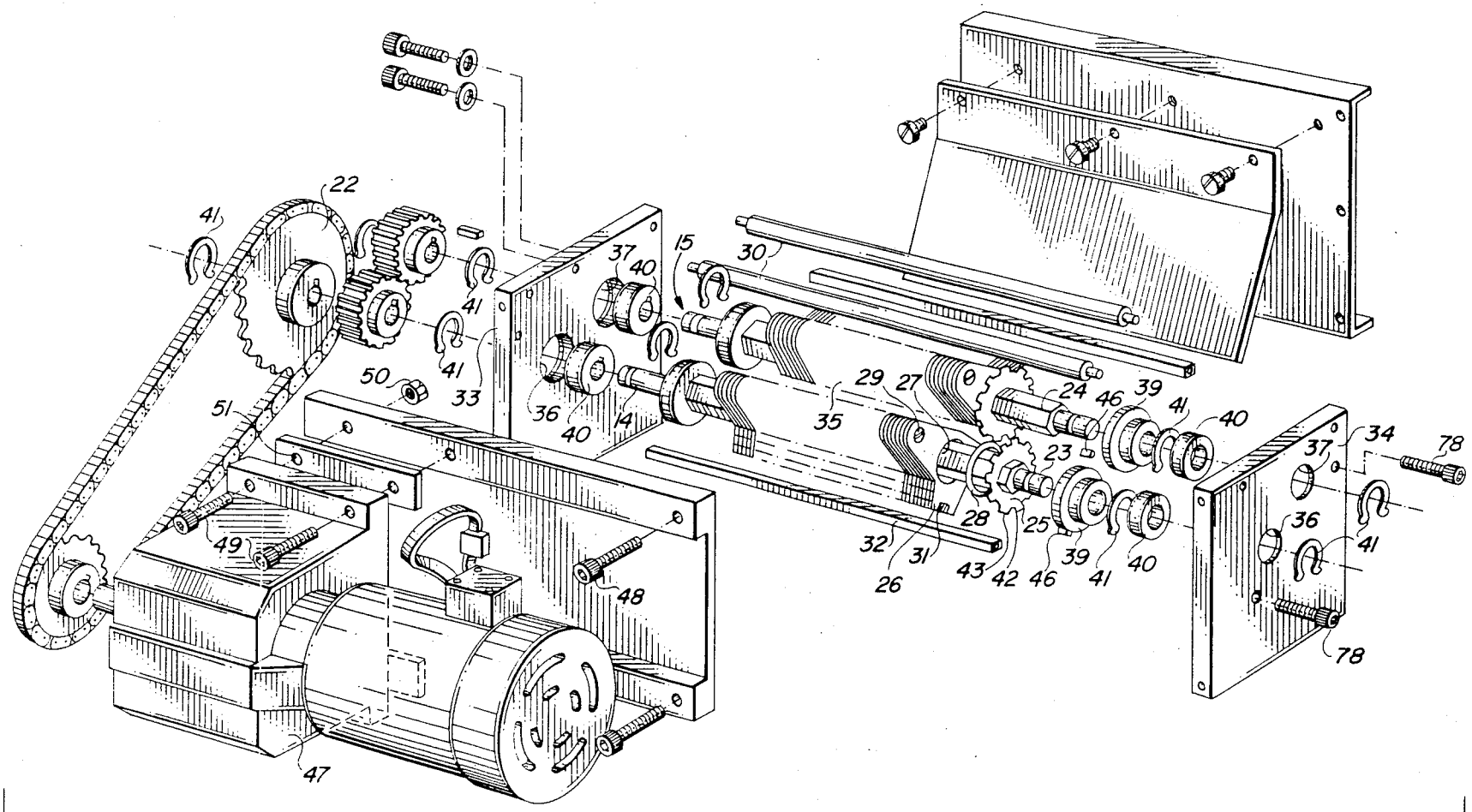
FIG. 3 is an exploded view of the cutter assembly unit and the drive in the relative relationship.

A document shredder 10 includes a casing 11 mounted over a frame 12. The casing includes a chute 13 for documents to be fed into a cutter unit. Within the cutter unit are two cutter assemblies 14 and 15. Mounted adjacent the cutter unit is a motor 16 which drives a planetary gear system 17 mounted with the output drive of the motor 16. An output shaft 18 from the planetary gear system 17 is connected with a sprocket gear 19 which, through a chain 20, drives a sprocket gear 21. The chain 20, in turn, drives two associated sprocket gears 22 mounted on the ends of shafts 23 and 24 of the cutter assemblies 14 and 15.

Each of the shafts 23 and 24 has an hexagonal crossection. There is mounted on the hexagonal cross-sectional shafts 23 and 24, cutter discs 25 alternately with spacers 26. The bore 27 of spacers 26 is circular and fits about the shafts 23 and 24 so that when the shafts 23 and 24 rotate, the spacers are not forced to rotate with the rotating shafts. On shaft 23 there are also located rings 28 which have a circular crosssection. The outside diameter of the rings 28 is such that they fit within the bore 27 of the spacers 26. The inside diameter of the rings 28 is also circular and is approximately the same length as the greatest length across the hexagonal cross-section of the shafts 23 and 24. Thus, the rings 28 are not caused to rotate as shafts 23 and 24 rotate.

On shaft 23 the effect of the relationship of the alternating cutter discs 25 spacers 26 with rings 28, is that when the cutter assembly 14 is formed by feeding the components together and torqued by a compression force, the rings 28 permit relatively less axial movement of the cutter discs 25 since each ring is of a greater thickness than each spacer. This relatively less or limited movement is in comparison shaft 24 which does not have the rings 28 within each of spacers 26. In that-situation on shaft 24, the cutter discs 25 have relatively greater freedom to move in the axial sense. The rings or washers 28 are made of a brass material known as Tuf-trite (Trademark) since minimal lubrication is required.

The spacers 26 have a secondary bore 29 adjacent main bore 27 through which stabilizing rods 30 can pass. There is also a square cut out formation 31 in the perimeter of the spacers 28 for receiving a rectangular bar 32. The ends of bars 30 and 32 are mounted within apertures on the cutters stands plates 33 and 34 at the axial ends of the cutter assemblies 14 and 15. In this manner, the spacers 26 are stabilized against forces which urge them to rotate as the cutter discs 25 rotate when documents are passed through the nip 35 between the cutter assemblies 14 and 15. The cutter assemblies 14 and 15 are constructed so that the cutter discs 25 overlap each other to form the nip 35 between them so documents can be shredded as they pass between the cutters 25. The shafts 23 and 24 are located in bores 36 and 37 respectively in the cutter stand plates 33 and 34 and are rotatable. Collars 39 and bearings 40 permits for this shaft rotation, these collar and bearing components being held in place by rings 41. The collars 39 can be adjusted axially on the shafts 23 and 24 and in this manner the compressive axial force on the shredder is additionally adjustable.

Each of the cutter discs 25 have slots 42 spaced circumferentially around the discs 25 with intervening teeth 43. The width of each of discs 25 is approximately 1/38" and the circumferential length of each slot is ¼". Each tooth is about ½" in circumferential length. The overall axial length of the cutter assemblies 14 and 15 is between 15" and 22". In the preferred heavy duty embodiment the assemblies 14 and 15 have an axial length of about 20" so that paper or documents of about 20" width can be fed into the document shredder. With dimensions of the tooth above the documents should be shredded into strips of a width of about 1/32" to 1/38" and a length of about ⅜" to ½".

Figure 4:
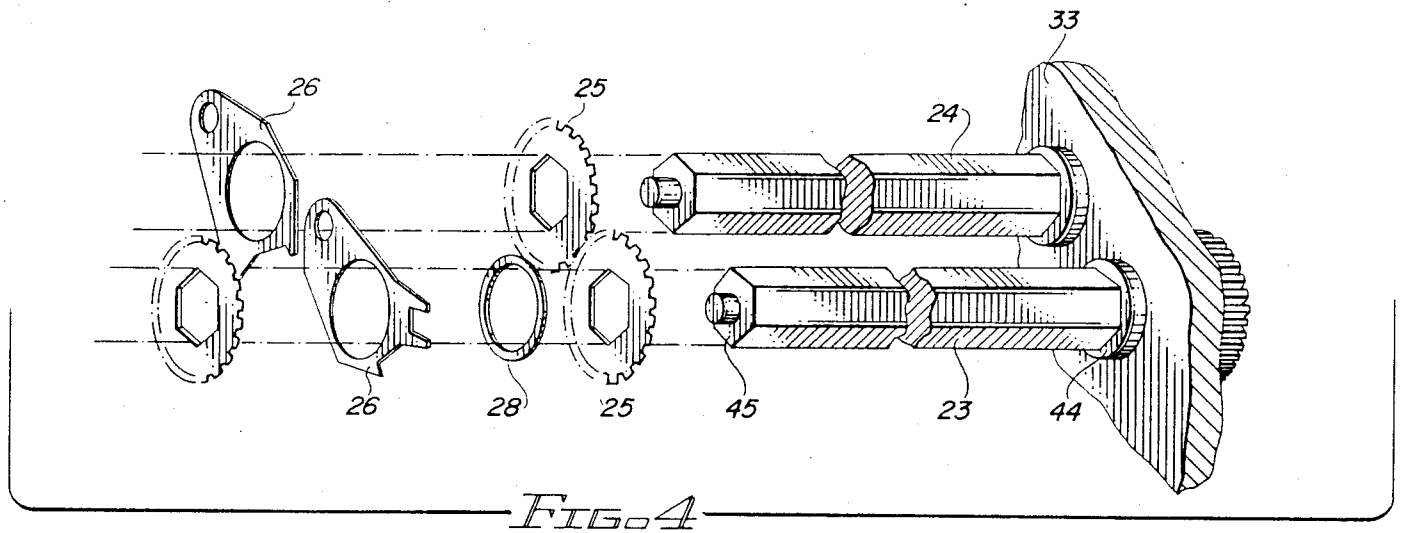
FIG. 4 is a perspective side view of the cutter assemblies showing the shafts, cutter discs, spacers and rings.

With particular reference to FIG. 4, it can be seen the shaft 23 is loaded alternately with the cutter discs 25, rings 28 and spacers 26. Shaft 24 receives only the cutter 25 and the spacer 26. A cutter disc 25 on shaft 23 is first put on and goes to the bottom 44 adjacent the cutter stand plate 33. Next, a ring 28 and spacer 26 is fed on to shaft 23 and a cutter disc 25 is fed on shaft 24. Thereafter, a cutter disc 25 is fed on to shaft 23 and a spacer 26 is fed on shaft 24. In this manner, the discs 25 and shafts 23 and 24 overlap to form the nip 35.

When all the discs 25, rings 28 and spacers 26 are mounted on shaft 23, and the cutters 25 and spacers 26 are mounted on shaft 24, collars 39 are mounted to the ends 45 of the shafts 23 and 24 and anchored with Allen screws 46 to the shaft ends 45. The collars 39 are drawn up tightly on the ends 45 to apply a compressive force axially along shafts 23 and 24.

With this arrangement, the rings 28 located in the bores 27 within the spacer 26 permit for a tighter or more frictionful engagement between the spacer 26, rings 28 and discs 25 on shaft 23 relative to the abutting engagement of the spacers 26 and cutters 25 on shaft 24 since each ring is a thickness greater than each spacer. This provides for some relative axial movement or "flexing" the overlapping discs 25, Should a foreign object enter between the cutter assemblies 14 and 15, there is sufficient give and flexibility to permit removal of the foreign object from the assemblies 14 and 15. This is particularly so when the cutter assemblies 14 and 15 are driven in reverse by the motor 16. In the alternative should the foreign object pass through the cutter assemblies 14 and 15 because of the axial flex, the shredding action on the documents is not impaired.

The motor 16 is a single phase 1.5 horsepower motor which drives the speed reducer 17. Through the sprocket gear 19, chain 20, and sprocket gear 21, and in turn, gears 22 the cutter assemblies 14 and 15 are rendered rotatable. The cutter assemblies 14 and 15 are sufficiently long to receive 20" width documents for shredding. The speed reducer 17 is a planetary gear system which has an efficiency rating of greater than about 90 percent. Power from the motor 16 is thus efficiently transferred to the cutter assemblies 14 and 15.

Figure 5:
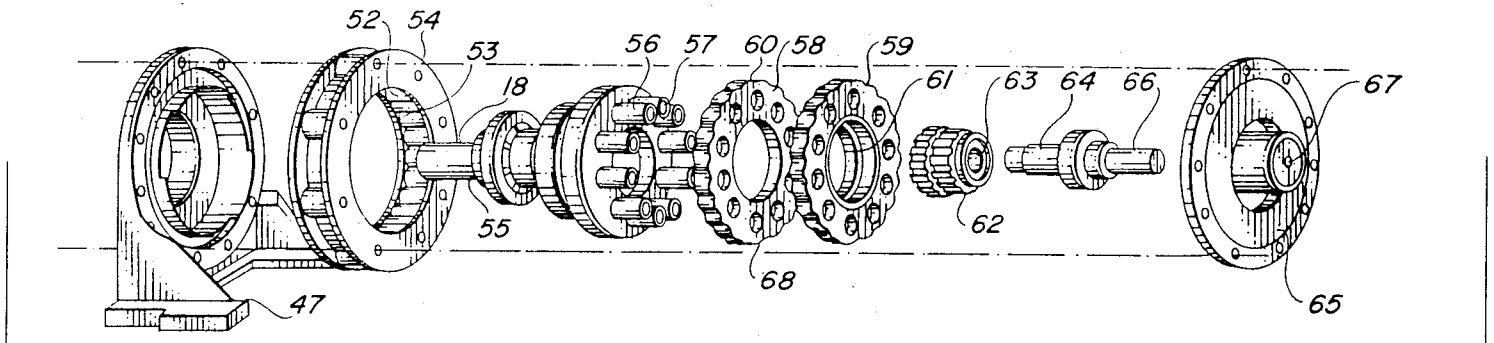
FIG. 5 is an exploded side view of a planetary gear system of the drive.

Reference to FIG. 5 illustrates a Cycloid (trademark) speed reducer of Sumitomo Machinery Corporation of America. Such a speed reducer 17 is suitable for the gear system of the shredder. The reducer 17 includes a casing 47 which is mounted on end wall 48 of the cutter assembly through nuts 49 with fit on bolts 50, the bolts 50 passing through bores 51 of the side wall 48. Within the casing 47, there is located a ring gear roller 52 which has ring gear pins 53 Inside a stationary ring gear 54, there is located a slow speed shaft 55 which mounts a slow speed shaft roller 56 with slow speed shaft pins 57. A pair of cycloid discs 58 and 59 have bores 60 which are fitted onto the shaft pins 57. Inside a central wall 61 for the cycloid discs 58 and 59, there is fitted an eccentric bearing assembly 62 with a bore 63 into which is fitted a high speed shaft 64. The gear reducer 17 is closed with an end shield 65. The free end 66 of the high speed shaft 64 passes through a bore 67 of the high speed end shield 65. The free end 66 engages with the output shaft of the motor 17. The slow speed shaft 15 has free end 18 which passes through the opposite end of the casing 47 and engages with the sprocket gear 19.

The gear system speed reducer 17 has only three major moving parts, the high speed input shaft 64 with the integrally mounted eccentric bearing assemblies 62, the cycloid pair of discs 58 and 59, and the slow speed shaft assembly 55.

As the high speed shaft 64 is turned by the motor 17, with the bores 63, the eccentric bearing assembly 62 also rotates. It causes the cycloid discs 58 and 59 to roll around the internal circumference of the stationary ring gear 54. The resulting action is similar to that of a wheel rolling along the inside of the ring. As the cycloid discs 58 and 59 travel in a clockwise path around the ring gear 54, the discs 58 and 59 turn in a counter-clockwise direction around their own axis. The teeth 68 of the cycloid discs 58 and 59 are engaged with the pins 53 of the fixed ring gear 54, thus providing a reverse rotation at a reduced speed. For each complete revolution of the high speed shaft 64, the cycloid discs 58 and 59 are advanced a distance of one tooth in a reverse direction. The movement of the cycloid discs 58 and 59 is transmitted to the slow speed shaft assembly 55 by projection of pins through the wires of the discs 58 and 59. The two discs 58 and 59 increase the torque capacity.

Other suitable planetary gear systems can be used provided the efficiency between the input and the output is higher than about 90 percent. The advantage of this is that this permits a lower horsepower single phase motor drive 17 to be used to drive a 20 inch long cutter assembly. In other embodiments, the same combination can be used for cutter assemblies between 15" and 22".

Power for the drive motor 16 is through 115 volt, 60 cycle cable supply 69. The cable 69 feeds a control system 17 and the output motor cable 71 feeds into the connector box 72 of the motor 16. The control box 70 is mounted on a frame base plate 12 and includes a sensor diagrammaticallY illustrated as 73 for sensing current drawn by the motor 16. The sensor 73 cooperates with a relay diagrammatically illustrated as 74 such that when a current drawn by the motor 16 exceeds a predetermined value when the motor is operating in a forward direction, the relay 74 acts to reverse the direction of motor 16. A timer 75 is operable with the relay 74 to permit reversal of the motor 16 after a predetermined time and for a predetermined time. Thereafter the relay 74 causes the motor to operate in a forward direction. An auto reverse adjuster 76 is provided and connected to the sensor 73 so that the control sYstem 70 can be set to effect reversal for different sensed currents. Thereby the cutter unit 9 can be arranged for shredding according to the number and width of documents. Power to the shredder cable 69 is controlled by a circuit breaker 77 mounted on the control system 70.

The shredder of the invention provides for highly efficient operation for wide documents through the cutter assemblies, while operating on a single phase motor with an efficient speed reduction system. The relative axial flexibility of the one cutter assembly relative ,to the other permits for easy removal of foreign objects which may get jammed in the shredder either when the shredder is stationary or when the cutter is in reverse.

Should the axial compressive force on either of the shafts 23 and 24 need to be adjusted, there is provided adjustment means 78 which pass through the cutter stand plate 34 to pressure the elements of the shaft 23 and 24 as they may be required.

The shredder is to receive up to 20 sheets at a time with a shred size of between 1/38"×3/8" and with a tolerance of 3/64". With a cutter head of 20", the exposed part of the cutter assemblies 14 and 15 is about 18". In some cases, the motor power can be increased to 2.0 horsepower while still operating from a single phase of supply. The amperage drawn is usually less than 17 amps, and hence the operation is efficient and this unit can be easily located in a location supplied with single phase power.

Although certain embodiments have been shown and described in detail, it should be understood that various changes and modifications may be made therein without departing from the scope of the appended claims. For instance, in other cases it could be possible than that of have rings on both shafts; the rings being on the one shaft being of a different depth than that of the rings on the other shaft. The invention is to be considered in term of the spirit and scope of the following claims.

What is claimed:

1. A document shredder comprising first and second cutter assemblies, each cutter assembly including (a) a shaft mounted on a frame;

(b) cutter discs mounted on each shaft at spaced intervals, the shafts being parallel and spaced apart a distance such that the discs on the shaft of the first cutter assembly extend into spaces between the discs on the shaft of the second cutter assembly in overlapping relationship to form a nip;

(c) a drive rotating the shafts so that documents fed into the nip are cut into strips by the action of the overlapping discs; and (d) a spacer mounted between every two immediately adjacent discs on each shaft, each spacer having a main bore in which its respective shaft is received, only the shaft of the first cutter assembly having ring elements thereon, each ring element being of greater thickness than that of each spacer, each ring element fitting over its shaft and being located within the main bore of one of the spacer such that greater axial movement between the discs on the shaft of the second cutter assembly relative to the axial movement between the discs on the shaft of the first cutter assembly is provided.

2. The shredder as claimed in claim 1 wherein substantially the same spacing is provided between the discs along each shaft and wherein compressive forces are applied to each cutter assembly, such that a requisite degree of axial rigidity is provided to each cutter assembly.

3. The shredder as claimed in claim 2 wherein the cutter discs have a bore with a cross section to mate with a cross section of the shafts such that as the shafts rotate the cutter discs rotate, and wherein that the spacers are stationary during shaft rotation.

4. The shredder as claimed in claim 3 wherein the main bore of each spacer is circular, and each ring element has a circular profile with a diameter to fit in the spacer main bore.

5. The shredder as claimed in claim 4 wherein each ring element has an inside circular profile with a diameter about equal to the largest distance across the cross section of the shaft.

6. The shredder as claimed in claim 5 wherein the cross section of the shaft is hexagonal.

7. The shredder as claimed in claim 6 wherein the spacers include a second bore adjacent the main bore, the second bore receiving a rod mounted on the frame parallel to the shaft, and the spacers also including a formation which mates with a bar, the bar being mounted parallel With the shaft and the rod, the rod and bar anchoring the spacers against rotation.

8. The shredder as claimed in claim 7 wherein the discs have teeth located around the circumference of the discs, the teeth being alternately spaced with slots, and the size of the teeth being formed such that documents passed into the nip between adjacent cutter assemblies are cut to the size of about 1/32" width by about ½" length.

9. The shredder as claimed in claim 8 wherein each slot is about ¼" in circumferential length and each tooth is about ½" in circumferential length, and the thickness of each disc and each spacer is about 1/38".

10. The shredder as claimed in claim 9 wherein each cutter assembly extends between about 15" to 22" in axial length.

11. The shredder as claimed in claim 10 wherein each cutter assembly is about 20" in axial length.

12. The shredder as claimed in claim 11 wherein the drive includes a single phase electric motor and a planetary gear system.

13. The shredder as claimed in claim 12 wherein the drive is selectively operable in a forward and a reverse direction, and relative axial movement between the overlapping discs of the cutter assemblies permitting for removal of foreign objects in the nip on reversal of the drive.

14. The shredder as claimed in claim 13 wherein the planetary gear system has an efficiency rating of greater than bout 90% such that, for a cutter assembly axial length of about 20", the power of the motor is about 1.5 horsepower.

15. The shredder as claimed in claim 14 including a sensor for sensing current drawn by the motor, a relay responsive to the sensor such that when the current drawn by the motor exceeds a predetermined value when the motor is operating in a forward direction, the relay acts to reverse the motor direction.

16. The shredder as claimed in claim 15 including a timer for permitting reversal of the motor for a predetermined time, and thereafter the relay causes the motor to operate in the forward direction.

17. A document shredder comprising a first cutter assembly and a second cutter assembly each including a shaft mounted on a frame, cutter discs mounted on each shaft at spaced intervals, the shafts being parallel and spaced apart a distance such that the discs on one of the shafts extend into spaces between the discs on the other shaft in overlapping relationship to form a nip, a drive rotating the shafts so that documents fed into the nip are cut into strips by the action of the overlapping discs, the cutter assemblies being formed such that a spacer is mounted between every two immediately adjacent discs on each shaft, each spacer having a main bore in which its respective shaft is received;

only the shaft of the first cutter assembly having ring elements thereon, each ring element being of greater thickness than that of each spacer, each ring element fitting over its shaft and being located within the main bore one of the spacers such that greater axial movement between the discs on the shaft of the second cutter assembly relative to the axial movement between the discs on the shaft of the first cutter assembly is provided, the shredder further having a single phase motor driving a planetary gear system for operation of the shredder.

18. The shredder as claimed in claim 17 wherein such cutter assembly extends between about 15" to 22" in axial length.

19. The shredder as claimed in claim 18 wherein each cutter assembly is about 20" in axial length.

20. The shredder as claimed in claim 19 wherein the planetary gear system has an efficiency rating of about 90% such that, for a cutter assembly axial length of about 20", the power of the motor is about 1.5 horsepower.

21. The shredder as claimed in claim 20 wherein the discs have teeth located around the circumferential of the discs, the teeth being alternately spaced with slots, and the size of the teeth being formed such that documents passed into the nip between adjacent cutter assemblies are cut to the size of about 1/32" width by about ½" length.

22. A document shredder comprising first and second cutter assemblies, each cutter assembly including, (a) a shaft mounted on a frame;

(b) cutter discs mounted on each shaft at spaced intervals, the shafts being parallel and spaced apart a distance such that the discs on the shaft of the first cutter assembly extend into spaces between the discs on the shaft of the second cutter assembly in overlapping relationship to form a nip;

(c) a drive rotating the shafts so that documents fed into the nip are cut into strips by the action of the overlapping discs;

(d) a spacer mounted between every two immediately adjacent discs on each shaft, each spacer having a main bore in which its respective shaft is received, only the shaft of the first cutter assembly having ring elements thereon, each ring element being of greater thickness than that of each spacer, each ring element fitting over its shaft and being located within the main bore of one of the spacers such that greater axial movement between the discs on the shaft of the second cutter assembly relative to the axial movement between the discs on the shaft of the first cutter assembly is provided, each disc having teeth located around a circumference thereof, the teeth being alternatingly spaced around said circumference with slots, and the size of the teeth being formed such that documents passed into the nip are cut into relatively narrow strips of relatively short length.

23. The document shredder as claimed in claim 22 wherein the strips are cut to a width of about 1/32", and a length of about ½".

24. The shredder as claimed in claim 23 wherein each slot has a circumferential length of about ¼" and each tooth has a circumferential length of about ½", each disc having a thickness of about 1/38".

25. The shredder as claimed in claim 22 wherein each cutter assembly extends about 15" to 22" in axial length.

26. The shredder as claimed in claim 22 wherein each cutter assembly extends about 20" in axial length.

27. The shredder as claimed in claim 22 wherein the drive includes a single phase electric motor and a planetary gear system.

28. The shredder as claimed in claim 27 wherein the drive is selectively operable in a forward and a reverse direction, the relative axial movement between the overlapping discs of the cutter assemblies permitting for removal of foreign objects in the nip on reversal of the drive.

* * * * *